United States Patent [19]

Babendererde et al.

[11] Patent Number: 4,844,656

[45] Date of Patent: Jul. 4, 1989

[54] EARTH PRESSURE SHIELD

[75] Inventors: Siegmund Babendererde, Bad Vilbel; Otto Braach, Wesel-Obrighofen, both of Fed. Rep. of Germany

[73] Assignee: Hochtief Aktiengesellschaft Vorm. Gebr. Helfmann, Essen, Fed. Rep. of Germany

[21] Appl. No.: 175,191

[22] Filed: Mar. 30, 1988

[30] Foreign Application Priority Data

May 1, 1987 [DE] Fed. Rep. of Germany ..... 3714617

[51] Int. Cl.[4] ..... E21D 9/06

[52] U.S. Cl. ..... 405/144; 405/138; 299/33; 299/56

[58] Field of Search ..... 405/132, 138, 141, 144; 299/55, 56, 33, 58; 137/855

[56] References Cited

U.S. PATENT DOCUMENTS

| | | | |
|---|---|---|---|
| 249,557 | 11/1881 | Truesdell | 137/855 |
| 1,530,113 | 3/1925 | Gibson | 137/855 |
| 3,266,257 | 10/1966 | Larrouze | 299/56 X |
| 4,040,666 | 10/1977 | Uchida et al. | 405/141 X |
| 4,068,485 | 1/1978 | Stuckman et al. | 405/141 |
| 4,165,129 | 8/1979 | Sugimoto et al. | 405/141 X |
| 4,436,448 | 3/1984 | Magnus et al. | 405/143 |
| 4,569,208 | 2/1986 | Villa | 137/855 X |
| 4,607,889 | 8/1986 | Hagimoto et al. | 299/56 X |
| 4,629,255 | 12/1986 | Babendererde | 299/56 X |
| 4,729,693 | 3/1988 | Hentschel | 405/144 |

FOREIGN PATENT DOCUMENTS

| | | | |
|---|---|---|---|
| 1203301 | 10/1965 | Fed. Rep. of Germany | 299/33 |
| 1222099 | 8/1966 | Fed. Rep. of Germany | 405/132 |
| 2245501 | 4/1974 | Fed. Rep. of Germany | 405/141 |
| 2512689 | 10/1975 | Fed. Rep. of Germany | 137/855 |
| 2926288 | 1/1981 | Fed. Rep. of Germany . | |
| 3118523 | 12/1982 | Fed. Rep. of Germany | 405/141 |
| 3418180 | 1/1986 | Fed. Rep. of Germany | 299/33 |
| 3446895 | 7/1986 | Fed. Rep. of Germany | 405/144 |
| 93519 | 5/1987 | Fed. Rep. of Germany | 405/141 |
| 67723 | 6/1973 | Luxembourg . | |
| 1406276 | 10/1975 | United Kingdom | 405/144 |
| 2029477 | 3/1980 | United Kingdom | 405/141 |
| 2177741 | 1/1987 | United Kingdom | 405/141 |

OTHER PUBLICATIONS

"beton-und Stahlbetonbau", 6/1986, pp. A17-A18.
"Tunnels & Tunnelling", Jan. 1986, pp. 28 and 29.
"100 Jahre Firma Wayss & Freytag Hydroschild", received in German Patent and Trademark Office, Jun. 18, 1975, pp. 250-256.
"Schweizer Ingenieur and Architekt" 42/1980, pp. 1028-1031.
"Tunnels & Tunnelling" Feb. 1983, p. 65.

*Primary Examiner*—David H. Corbin
*Assistant Examiner*—Arlen L. Olsen
*Attorney, Agent, or Firm*—Herbert Dubno

[57] ABSTRACT

The earth pressure shield contains a front working compartment having a digging tool and formed by a separating wall. An annular space is formed in the front working compartment with a top region connected with a regulated pressurized air feed and with a bottom region open to the digging tool so that dug or mined earth material is removable with the help of a conveyor unit. At least one fluid pipe is guided from a fluid chamber with a level controller and a fluid feeder to a fluid outlet open to the digging or mining tool in the working compartment. An especially reliable operation is attained when a bulkhead space is provided by partitioning behind the working compartment and/or the circular space formed with an immersed wall. This bulkhead space is connected in its upper region with the top region of the annular space by an opening in the separating wall and includes the fluid chamber in its lower region.

5 Claims, 2 Drawing Sheets

EARTH PRESSURE SHIELD

FIELD OF THE INVENTION

Our present invention relates to an earth pressure shield used in underground construction and, more particularly, to an earth pressure shield for a tunnel and/or gallery excavator used in mining.

BACKGROUND OF THE INVENTION

An earth pressure shield can have a front working compartment having at least one digging or mining tool and formed by a separating wall, in which a circular space is formed with a top region connected with a regulated pressurized air feed and with a bottom region open to the digging or mining tool so that the dug or mined earth material is removable with the help of a conveyor unit. At least one fluid pipe is guided from a fluid chamber with a first level controller and a fluid feeder to a fluid outlet open to the digging or mining tool.

The separating wall forms a reinforcing annular space which is triangular in cross section in which earth material mixed with fluid can enter whereby the corresponding fluid pipe or duct can be clogged.

Tunnels are driven through loose earth with a tunnel and/or gallery digging machine. For support of the local front wall during digging or mining of the earth the partitioned or compartmentalized front part of the tunnel and/or gallery digging machine advantageously is filled with a fluid which stands under a regulated pressure.

In this partitioned portion the digging unit itself is located, usually a digging wheel with which the earth is loosened. This loosened earth then drops into the supporting fluid and is pumped together with it from the partitioned region and fed to a separating plant. There the earth is separated from the supporting fluid and the fresh supporting fluid is pumped into the front partitioned portion of the tunnel and/or gallery digging machine.

This process has proven to be effective, particularly when in the partitioned portion of the tunnel and/gallery digging machine, the so-called working compartment, an immersed wall is formed and extends almost to the base of the unit and in the rear part of the machine, which is separated from the working compartment by the immersed wall, a regulatable pressurized air cushion or reservoir provides a constant pressure to the supporting fluid at the local front wall.

Because of the pressure cushion pressure fluctuations are reduced, which would arise if the volume of the pumped supporting fluid enriched with earth material was not enough to correspond or keep up with the purified fluid fed back to the machine.

Other methods are known in which the fluid flow rates from and to the unit are measured in operation. Volume differences arising can then be balanced by regulating valves and pumps. However these mechanical devices react slowly in comparison to the automatic pressure balancing due to the pressurized air cushion and in fact the pressure fluctuations in the supporting fluid are thus larger.

The above described method is however limited to earth in which the solid earth components can be separated in a separating unit from the supporting fluid. This is not possible in coherent earth with a high solid component or only at great cost. Tunnels in this earth are driven with tunnel and/or gallery digging machines with which the loosened earth material instead of the supporting fluid should support the local front wall in the partitioned working compartment.

This earth material is however substantially more viscous and is pumped from the working compartment not with a rotary pump, but is usually with a conveyor unit. It is predominantly removed and deposited without additional processing. The reliable support of the local front wall is however problematical.

In the tunnel and/or gallery machine known up to now, an attempt is made to provide a constant supporting pressure on the local front wall and to guarantee because of that that volume of earth material dug by the digging wheel is never less than that removed by the conveyor. This is effected by control and regulation of the tunneling pressure of the tunnel and gallery digging machine and the performance of the conveyor. However the control and regulating elements for doing this are too coarse.

When too much earth is removed from the working compartment, the supporting pressure is lowered. The local front wall is released from the applied pressure. Earth from above the roof of the tunnel and/or gallery digging machine is forced into the tunnel cross section and the surface of the ground above is lowered.

If too little earth is removed or withdrawn from the working compartment, the earth material obtained is compressed. It is thus inclined to clog the conveyor unit. An increased supporting pressure on the local front wall occurs acting to lift the surface of the ground.

To minimize these undesirable possibilities, pressure cells are built in at the rear wall of the working compartment to maintain a reliable direct measurement of the supporting pressure in the working compartment.

However the pressure measuring devices are usually unreliable instruments. They are often driven off scale by the relatively rigid earth material. Moreover they only give information about the pressure in a very limited local region.

An essential basis for reliable support of the local front wall in a tunnel and/or gallery digging machine which itself uses the dug earth material as a supporting medium which is only as reliable as necessary is the following: the earth material is compressible and thus pressure can be transmitted only in a locally limited way. That has the consequence that the attained supporting pressure on the local front wall, especially in the vicinity of the roof of the tunnel and/or galler digging machine, can not be reliably transmitted. An increase of the generated earth material considerably changes the transmittability of a supporting pressure.

In the processes known up to now the attempt is made to overcome the above mentioned disadvantages by feeding in water or a suspension locally or, more generally, ground material which has physical properties approaching those of a viscous fluid into the working compartment. Furthermore mixing vane elements on the digging wheel and on the pressure wall are built in to mix the earth material with the fed in fluid and provide a homogeneous mixture.

Methods are known with which a fluid is pumped in the space directly in front of the digging wheel through the arms of the digging wheel when the digging wheel loosens the earth.

Also processes exist in which by regulated injection of fluid, e.g. in the region of the roof, an attempt is made to attain at least a constant supporting pressure there.

However in all these endeavors mechanical devices are used which only react slowly such as valves and pumps. Also the measuring devices used only can contribute to a certain extent to an increase in the reliability of the supporting pressure on the local front wall.

OBJECTS OF THE INVENTION

It is an object of our invention to provide an improved earth pressure shield which avoids the difficulties and disadvantages mentioned above.

It is also an object of our invention to provide an improved earth pressure shield which can assist a tunnel and/or gallery digging machine dig a tunnel in cohesive loose ground while maintaining a reliable support of the local front wall.

SUMMARY OF THE INVENTION

These objects and others which will become more readily apparent hereinafter are attained in accordance with our invention in an earth pressure shield with a front working compartment having at least one digging or mining tool and formed by a separating wall, in which an annular space is formed with a top region connected with a regulated pressurized air feed and with a bottom region open to the digging or mining tool so that the dug or mined earth material is removable with the help of a conveyor unit. At least one fluid pipe is guided from a fluid chamber with a first level controller and with a fluid feeder to a fluid outlet open to the digging or mining tool.

According to our invention behind the working compartment and/or the circular space formed with an immersed wall a bulkhead space is provided by partitioning and is connected in an upper region with the top region of the annular space by an opening in the separating wall and includes the fluid chamber in a lower region.

In the earth pressure shield according to our invention an additional partition chamber or space, the bulkhead space, is provided to the rear of the working chamber in which the immersed wall is located and which partitions the front portion of the tunnel and/or gallery digging machine.

The drive for the digging wheel, the pressurized air feed for clearing the working compartment, if necessary, mixing devices and the conveyor unit, e.g. a screw conveyor, all of through this bulkhead space.

The lower far larger part of the bulkhead space is filled with water and/or a suspension while the upper part is filled with compressed air which because of the upper connection of the pressurized air cushion behind the immersed wall stands under the same predetermined pressure which acts on the earth material behind the immersed wall.

The fluid pipe, which can be circular, which opens in the lower portion of the bulkhead space, guides water and/or the suspension through the upper part of the bulkhead space filled with pressurized air and through the pressurized air cushion located behind the immersed wall in the vicinity of the roof of the front part of the working compartment. Also feeder means for water and/or suspension, which supply the bulkhead space which is penetrated by the digging tool through the digging tool is connected to the water filled bulkhead space.

The pressurized air cushion with a predetermined regulated pressure guarantees the same constant pressure on the earth material located behind the immersed wall and the water and/or suspension located in the partitioned portion. Measuring and control systems provide that the level of the earth material and the water itself are the same, i.e. at the same height. The shear resistance of the earth material in the working compartment now prevents the predetermined supporting pressure in pressurized air cushion from being transmitted to the local front wall, especially in the sensitive roof region. A zone of lower pressure arises in which then water and/or suspension flows into the roof region of the front part of the working compartment through the ducts from the bulkhead rear space.

A nonreturn valve opens only when the predetermined supporting pressure there is not attained. Simultaneously the water and/or the suspension standing under the predetermined supporting pressure flows by feed means in the digging wheel into the space through which the digging tool travels in front of the digging wheel.

The fluid standing under the predetermined supporting pressure guarantees a constant supporting pressure on the local front wall. The viscosity of the earth-water mixture is lowered by uniformly mixing the fluid with the earth material by the mixing tools. Consequently the shear resistance is gradually reduced so that the pressure transmission of the supporting pressure from the gas pressure cushion gradually becomes effective at the roof region.

After that, the fluid feed is interrupted. It is started up again when the supporting pressure drops because of a high shear resistance in the earth material under the pressure of the gas cushion. The automatic pressure regulation by the gas pressure cushion is responsible for not only a constant supporting pressure for the local front wall, particularly in the vicinity of the roof, but also for an automatic stabilization of the earth material being carried away. Mixing and stirring devices behind the immersed wall provide for a further uniform mixing of the earth material with the delivered fluid.

It is advantageous when the regulated pressurized air feed is guided through the partition or bulkhead of the bulkhead space. To obtain the best possible mixing of the dug earth material with the fluid (water and/or suspension), advantageously at least one stirring unit is located in the bottom region of the working compartment behind the immersed wall.

Another desirable feature of our invention comprises a nonreturn or check valve for the fluid outlet provided so that a predetermined supporting pressure is not exceeded. This nonreturn valve comprises advantageously a perforated metal plate which is overlayed on its free side with a slotted rubber or plastic plate. Advantageously portions of the working compartment behind the immersed wall can be provided with a second level controller which can cooperate or work with the conveyor unit.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
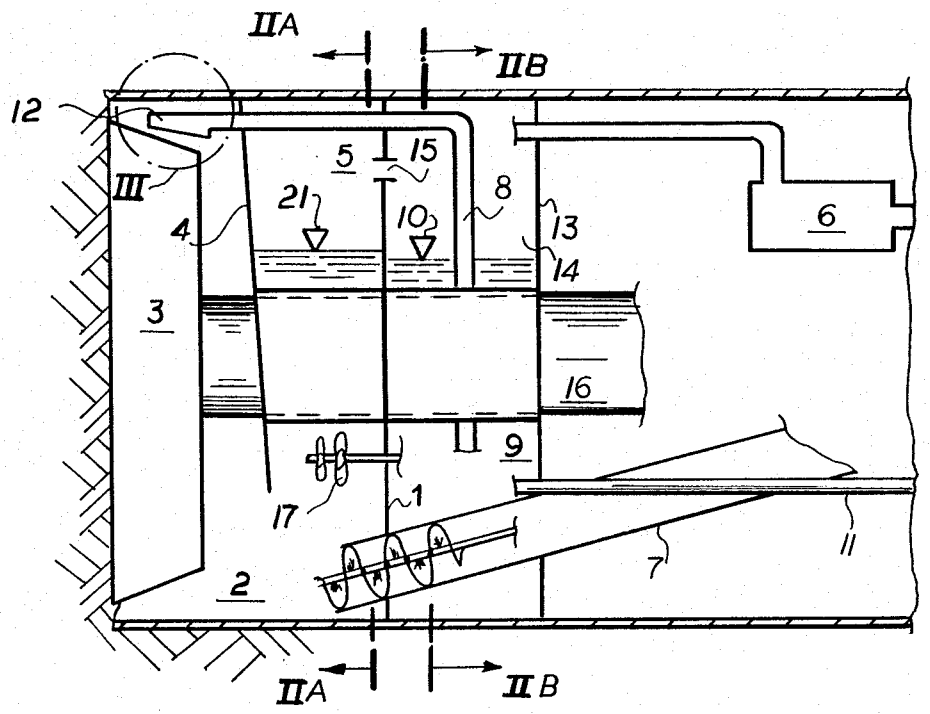
FIG. 1 is a longitudinal cross sectional view of an earth pressure shield according to our invention.
Figure 2A:
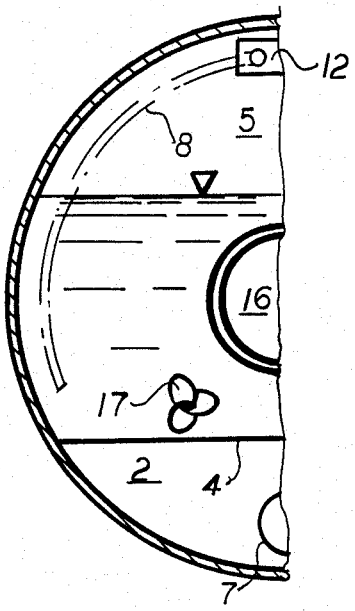
FIGS. 2*a* and 2*b* are respective half cross sectional views of the earth pressure shield taken along the lines IIA—IIA and IIB—IIB of FIG. 1.
Figure 2B:
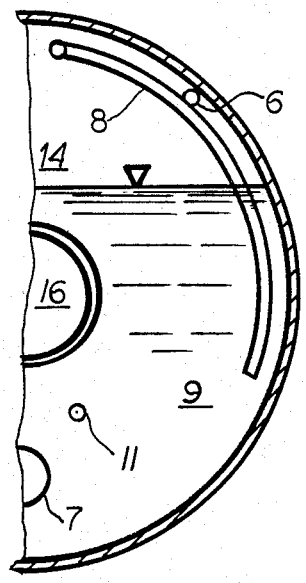

The earth pressure shield shown in FIGS. 1, 2*a* and 2*b* of the drawing has a front working compartment 2 formed by a separating wall 1 in which a digging or mining tool 3, specifically here a digging wheel, works.

In the working compartment 2 an annular space 5 is provided behind the digging or mining tool 3 with the help of an immersed wall 4. This circular space 5 is open in its bottom region to the working compartment 2 having the digging tool 3 and in its top region is in working connection with a controlled pressurized air feed 6.

Mined or dug earth material is removable with the aid of a conveyer unit 7, specifically here a screw conveyor. Two fluid pipes 8 extend from a fluid chamber 9 with a first level controller 10 and a fluid feeder 11 through the circular space 5 to a fluid outlet 12 which is open to the digging or mining tool 3. The fluid usually comprises water or a supporting suspension (e.g. bentonite in water).

A bulkhead space 14 is provided by a partition or bulkhead 13 behind the working compartment 2 and/or the annular space 5, which includes and/or forms the fluid chamber 9 in its lower region and is connected to the upper region of the annular space 5 in its upper region by an opening 15 in the separating wall 1.

In the lower part of the working chamber 2 two stirring units 17 are located behind the immersed wall 4 beside a drive axle 16 of the digging or mining tool 3.

Figure 3:
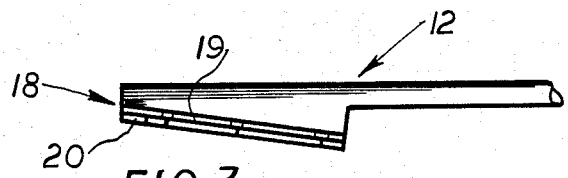
FIG. 3 is an enlarged-scale view of the portion III of the longitudinal cross sectional view shown in FIG. 1.
Figure 4:
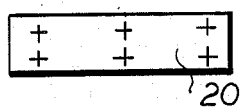
FIG. 4 is a bottom view of the component shown in FIG. 3.

From FIG. 3 it can be seen that the fluid outlet 12 comprises a nonreturn valve 18. As is apparent from FIG. 3 this nonreturn valve 18 is formed by a perforated metal plate 19 which is overlayed on its unattached side with a slotted rubber or plastic plate 20.

Should an overpressure exist in the fluid pipes 8, the fluid issues through the metal plate 19 and the slotted rubber and/or plastic plate 20. If the counterpressure is higher, the slotted rubber and/or plastic plate 20 keeps the perforated metal plate 19 automatically closed. The portion of the working compartment 2 positioned behind the immersed wall 4 is provided with a second level controller 21 which the conveyor unit 7 uses as a controlling or adjusting member.

By "behind" we mean the direction opposite to the forward digging direction associated with the tunnel and/or gallery digging machine.

By the "top" or "bottom" region or the "upper" or "lower" region (of the bulkhead space or the circular space) we mean the top or bottom half of the upper or lower half.

We claim:

1. An earth pressure shield for a tunnel digging machine comprising:

a front working compartment formed by a separating wall including:

at least one digging tool, an annular space formed with a top region and a bottom region, said top region being connected to a regulated pressurized air feed and said bottom region being open to said digging tool so that the dug earth material formed in said working compartment is removable, a conveyor unit for removing said dug earth material, a fluid chamber behind said separating wall, said chamber having a first level controller to regulate fluid in said chamber and having a fluid feeder delivering fluid therein, at least one fluid pipe at one end of which is a fluid outlet being guided from said fluid chamber through said annular space so that said fluid outlet is open to said digging tool, an immersed wall separating at least partially said digging tool from said annular space, at least one stirring unit being located in said bottom region behind an immersed wall separating at least partially said digging tool from said annular space, a second level controller located behind said immersed wall in said working compartment; and a bulkhead space provided by partitioning behind said working compartment formed with said immersed wall, said bulkhead space being connected in an upper region with said top region of said annular space by an opening in said separating wall and including said fluid chamber in a lower region, said partitioning being defined by a partition wall substantially parallel and opposite said separating wall, said fluid outlet including a non-return valve.

2. The improvement defined in claim 1 wherein said regulated pressurized air feed is guided through said partition wall of said bulkhead space.

3. The improvement defined in claim 1 wherein said nonreturn valve comprises a perforated metal plate, which is overlayed on a free side thereof with a slotted rubber or plastic plate.

4. The improvement defined in claim 1 wherein said fluid outlet opens in a space between said digging tool and said immersed wall.

5. An earth pressure shield for a tunnel digging machine comprising:

a front working compartment formed by a separating wall including:

at least one digging tool, an annular space formed with a top region and a bottom region, said top region being connected to a regulated pressurized air feed and said bottom region being open to said digging tool so that the dug earth material formed in said working compartment is removable, a conveyor unit for removing said dug earth material, a fluid chamber behind said separating wall, said chamber having a first level controller to regulate fluid in said chamber and having a fluid feeder delivering fluid therein, at least one fluid pipe at one end of which is a fluid outlet being guided from said fluid chamber through said annular space so that said fluid outlet is open to said digging tool, said fluid outlet comprising a perforated metal plate, which is overlayed on a free side thereof with a slotted rubber or plastic plate and which thus acts as a nonreturn valve, at least one stirring unit being located in said bottom region behind an immersed wall separating at least partially said digging tool from said annular space, a second level controller located behind said immersed wall in said working compartment; and a bulkhead space provided by partitioning behind said working compartment formed with said immersed wall, said bulkhead space being connected in an upper region with said top region of said annular space by an opening in said separating wall and including said fluid chamber in a lower region, said regulated pressurized air feed being guided through a partition wall of said bulkhead space, said partition wall being substantially parallel and opposite said separating wall.

* * * * *